US010900256B2

(12) United States Patent
Wurm

(10) Patent No.: US 10,900,256 B2
(45) Date of Patent: Jan. 26, 2021

(54) WINDOW OR DOOR LOCK

(71) Applicant: KABA GmbH, Herzogenburg (AT)

(72) Inventor: Christoph Wurm, Weinberg (AT)

(73) Assignee: DORMAKABA SCHWEIZ AG, Wetzikon (CH)

( * ) Notice: Subject to any disclaimer, the term of this patent is extended or adjusted under 35 U.S.C. 154(b) by 352 days.

(21) Appl. No.: 15/557,716

(22) PCT Filed: Mar. 22, 2016

(86) PCT No.: PCT/AT2016/050072

§ 371 (c)(1),
(2) Date: Sep. 12, 2017

(87) PCT Pub. No.: WO2016/149723

PCT Pub. Date: Sep. 29, 2016

(65) Prior Publication Data

US 2018/0058099 A1 Mar. 1, 2018

(30) Foreign Application Priority Data

Mar. 23, 2015 (AT) ..... A 50227/2015

(51) Int. Cl.

| | |
|---|---|
| ***E05B 17/22*** | (2006.01) |
| ***E05B 47/00*** | (2006.01) |
| ***E05B 41/00*** | (2006.01) |

(52) U.S. Cl.

CPC ..... *E05B 17/22* (2013.01); *E05B 41/00* (2013.01); *E05B 47/0046* (2013.01); *E05B 2047/0068* (2013.01); *E05B 2047/0069* (2013.01)

(58) Field of Classification Search

CPC ..... E05B 17/22; E05B 47/0046; E05B 2047/0069; E05B 2047/0068; E05B 41/00

See application file for complete search history.

(56) References Cited

U.S. PATENT DOCUMENTS

| | | | |
|---|---|---|---|
| 4,904,005 | A | 2/1990 | Frolov |
| 5,226,256 | A | 7/1993 | Fries |

(Continued)

FOREIGN PATENT DOCUMENTS

| | | | |
|---|---|---|---|
| DE | 19500054 | B | 7/1996 |
| DE | 102008035326 | A | 1/2010 |

(Continued)

*Primary Examiner* — Kristina R Fulton
*Assistant Examiner* — Thomas L Neubauer
(74) *Attorney, Agent, or Firm* — Andrew Wilford

(57) ABSTRACT

For simultaneous detection of the state of a locking element (12) and the state of the window or door, a lock (11) or fitting is provided, in which at least one coil (13) is arranged on the face plate (14) or on the strike plate, on the respective outer face thereof, wherein the coil (13) is arranged around the opening for the locking element (12). To determine the state of the door and the state of the bolt, an alternating voltage signal is applied to the coil (13), the impedance of the coil is determined, and said impedance is compared to predetermined values. To increase reliability, successive signals having different frequencies can be applied to the coil (13) and the impedance can be determined at said different frequencies and compared to predetermined values. Alternatively, a plurality of coils can be provided, namely a transmission coil (13*a*) and at least one receiving coil (13*b*), and the voltage induced in the receiving coil (13*b*) can be measured when an alternating voltage is supplied to the transmission coil (13*a*).

5 Claims, 3 Drawing Sheets

(56) References Cited

U.S. PATENT DOCUMENTS

| | | | | |
|---|---|---|---|---|
| 9,673,868 | B2 * | 6/2017 | Curtis | H04B 5/0037 |
| 9,957,733 | B2 * | 5/2018 | Webb | H02J 1/00 |

FOREIGN PATENT DOCUMENTS

| | | | |
|---|---|---|---|
| DE | 102009046060 | A | 4/2011 |
| DE | 202011108234 | U | 2/2012 |
| JP | 2008002203 | B | 1/2008 |

* cited by examiner 3 mm
5 mm
x
3 mm
5 mm
x
Inductivity (H)
Frequency (Hz)
1,000
10,000
100,000
1,000,0

3 mm
x
5 mm
x
3 mm
5 mm
Resistance (Ω)
Frequency (Hz)
1,000
10,000
100,000
1,000,000

5mm
x
3 mm
x
5 mm
3 mm
Inductivity (H)
Frequency (Hz)
1,000
10,000
100,000
1,000,000

3 mm
3 mm
x
x
5 mm
5 mm
Resistance (Ω)
Frequency (Hz)
1.000
10.000
100.000
1.000.000

WINDOW OR DOOR LOCK

CROSS REFERENCE TO RELATED APPLICATIONS

This application is the US-national stage of PCT application PCT/AT2016/050072 filed 22 Mar. 2016 and claiming the priority of Austrian patent application A50227/2015 itself filed 23 Mar. 2015.

FIELD OF THE INVENTION

The present invention relates to a window or door lock, particularly a mortise lock comprising a face plate, a strike plate, a locking element that can be extended through an opening of the face plate into an opening of the strike plate, and a device for detecting the status of the locking element by means of a coil that can be around the opening of the strike plate.

The present invention further relates to a method of determining the status of the locking element and of the status of the window or door with such a lock or window or door fitting. "Locking element" is intended to refer not only to latches and bolts, but also to catches or any element that can extend out of the face plate and then engage in the strike plate so that the door or window is fixed in the closed position.

PRIOR ART

Locks with which one can detect the status of the door, i.e. whether it is open or closed, are known, for example from DE 202011108234. In paragraph [0024] of that document, a button is described that is coupled with a magnet holder, with the position of the magnet being detected by a Hall-effect sensor. When the door is closed, the button is pressed by the strike plate into the interior of the lock and the magnet is also displaced, which can be detected by the Hall-effect sensor.

Similarly, locks are known with which the latch status, i.e. "locked" or "unlocked"—can be detected; for example, see DE 102009046060. In that document, a magnet is recessed in a latch, the position of the magnet being detected by magnetosensitive sensors.

One drawback of these solutions is that the lock must be altered mechanically in order to enable detection; in the first case, an additional button has to be provided, and in the second case, a bore (through hole or blind-end bore) for the magnet must be made in the latch, which weakens the latch. Moreover, space is required for each of the sensors, which must be mounted in very specific positions.

A lock of the type mentioned at the above is known from DE 19500054. According to that document, the coil is provided behind the strike plate. It is obvious that, with this arrangement, the position of the door (of the face plate) cannot have any noticeable influence on the coil. According to that document, only the latch status, i.e. "locked" or "unlocked," is detected.

OBJECT OF THE INVENTION

It is the object of the present invention to provide a door or window lock in which both the status of the locking element and the status of the window or door can be detected without the need for major mechanical alterations in the lock or in the window or door hardware.

SUMMARY OF THE INVENTION

According to the invention, this object is achieved by a lock or by window or door hardware of the type described above in that, in order to also detect the status of the window or door when the coil is provided around the opening of the strike plate, the coil is provided on an outside face of the strike plate; or, otherwise, the coil is provided on the face plate, on the outside thereof and around the opening thereof.

Therefore, only one coil is necessary on the face plate or on the strike plate (apart from the required electronics, whose position can be chosen arbitrarily, including outside the lock). Such coils can be imprinted on a foil, a preferably self-adhesive flexible printed circuit, which means that they can be made very thin so that the external dimensions of the lock (face plate thickness) and the thickness of the strike plate hardly change. The present invention can thus be retrofitted to an existing lock or window and door hardware.

It was found that the electrical measured values change both as a result of the status of the locking element and, to a lesser extent, as a result of the status of the door. Therefore, the status of the locking element and of the door can be inferred merely by electrical measurements without the need for additional buttons or alterations of the latch.

If a minimal overall height is to be achieved for the coil(s), it is advantageous if a sensor is provided for measuring the impedance of the coil while an alternating-voltage signal or alternating-current signal is applied to it. The face plate or the strike plate is thus made thicker only by the thickness of a coil. To wit, it was found that the impedance of the coil changes when the latch is retracted and extended and, to a lesser extent, when the strike plate comes into the proximity of the coil (as a result of the closing of the door).

The method of determining the status of the locking element and of the window or door with such a lock or window or door fitting is carried out by applying an alternating voltage or alternating-current signal to the coil, determining the impedance of the coil, and comparing it with predetermined values.

The reliability of the determination of the status of the locking element and of the window or door fitting can be increased substantially by successively applying signals of different frequency to the coil, determining the impedance at these different frequencies, and comparing them with predetermined values. For example, if one measures at three frequencies and infers the latch status and, optionally, the door status, a majority decision can be made if the results are different. On the other hand, it is often the case that two statuses at a certain frequency will produce very similar measured values and therefore can hardly be distinguished, so measurement at different frequencies is indicated for this reason alone.

If measurements are performed at several frequencies, the power consumption is of course greater compared to a single measurement, which is disadvantageous particularly in case of battery operation. If the overall height is not essential (for example, if a recess is provided on the face plate and/or on the strike plate), it is advantageous to provide two coils around the opening of the face plate or strike plate, namely a transmitter coil and a receiver coil, and to provide a sensor for measuring the voltage induced in the receiver coil while an alternating voltage is being applied to the transmitter coil. The induced voltage changes more substantially than the impedance, particularly when the status of the door changes. Measurements at different frequencies can thus be avoided, so that power consumption can be minimized.

The reliability can be increased even further if an additional receiver coil is provided, so that a receiver coil is provided on each side of the transmitter coil, and if a sensor is provided for measuring the difference between the voltages induced in the two receiver coils while an alternating voltage is being applied to the transmitter coil.

Three coils (each of which is printed on a foil) are thus mounted on the face plate one over the other, thus resulting in a kind of transformer. The transmitter coil is mounted symmetrically between the two receiver coils. If an iron core (or another metal) is disposed exactly symmetrically in this arrangement, then exactly the same voltage is induced in the two receiver coils, so the differential voltage between the two receiver coils is zero. However, if the iron core is displaced in one or the other direction, the arrangement becomes asymmetrical, and the more off-center the iron core is, the greater the signal that is measured.

The method of determining the status of the locking element and of the window or door with such a lock or window or door fitting is carried out by applying an alternating voltage or alternating-current signal to the transmitter coil, determining the voltage in the receiver coil or the differential between the voltages induced in the two receiver coils, and comparing this with predetermined values.

In order to compensate for long-term drift, it is advantageous if the values that are measured are stored and the predetermined values are reassigned based on the average of the latest measured values.

BRIEF DESCRIPTION OF THE DRAWING

The present invention will be explained in further detail with reference to the enclosed drawings in which.

SPECIFIC DESCRIPTION OF THE INVENTION

Figure 1:
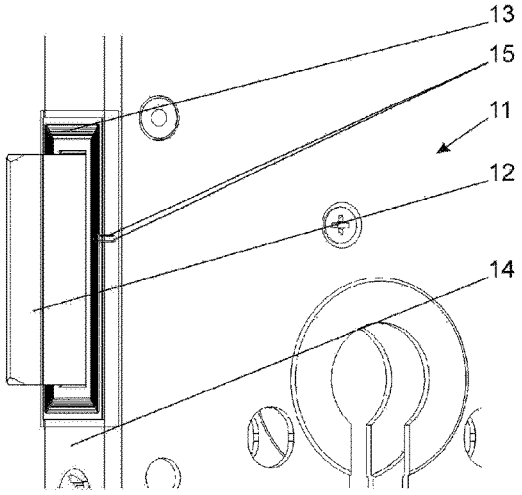
FIG. 1 shows a first embodiment of a mortise lock according to the invention near the latch.
Figure 2:
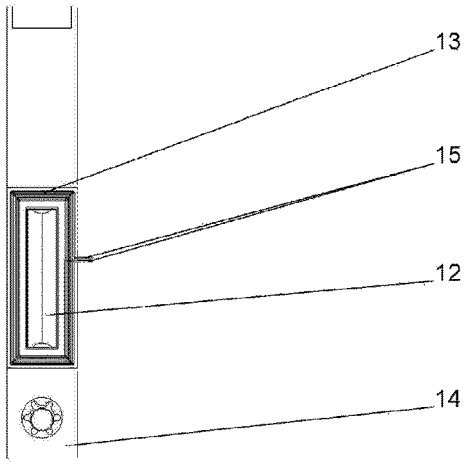
FIG. 2 is a top view of the face plate of this mortise lock near the latch.

As can be seen from FIGS. 1 and 2, a lock 11 with A locking element 12 has a coil 13 mounted on a face plate 14 and whose windings are provided around the locking element 12. The windings are located on a flexible printed circuit adhered to an underlying ferrite foil (Wirth-Elektronik, part number 354006). The locking element 12 here is a locking bolt, but the present invention can also be implemented with a drop latch. The term "locking element" is intended to include both the drop latch and the locking bolt.

Figure 3:
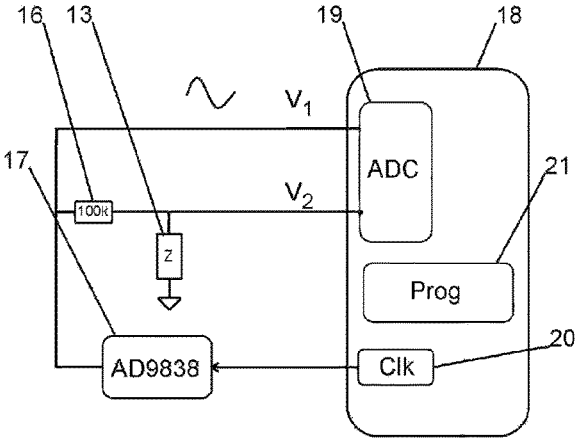
FIG. 3 is a circuit for determining the impedance.

In order to measure the impedance, the coil 13 is fed via contacts 15 a signal, a circuit suitable for this purpose being shown in FIG. 3. Accordingly, the coil 13 is controlled via a series resistor (in the example, $Rt_v$=100 kΩ) by a sine-wave generator 17 with an alternating-current sinusoidal voltage. The IC AD9838 by Analog Devices is suitable as a sine-wave generator serving as means for applying an alternating voltage. This can provide a frequency of up to 8 MHZ that can be adjusted by register. Moreover, it can be put into an idle state in which it hardly uses any power, which is advantageous in case of battery operation. In order to measure the impedance, a microprocessor 18 with an analog-to-digital converter 19 is provided. This analog-to-digital converter 19 alternately measures the voltages $V_1$ and $V_2$. $V_1$ is the voltage that the sine-wave generator 17 provides, and $V_2$ is the voltage that drops out right at the coil 13, i.e. the voltage shared between series resistor 16 and coil 13.

Figure 4:
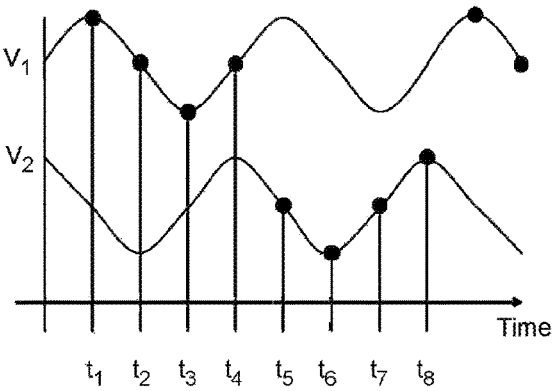
FIG. 4 shows two signals $V_1$ and $V_2$ from the circuit according to FIG. 3.

Typical signal shapes are shown in FIG. 4. In order to detect a sinusoidal signal, four measuring points are required: at a first time $t_1$, after a 1/4 period (time $t_2$), after a 1/2 period (time $t_3$), and after a 3/4 period (time $t_4$). Since a sinusoidal signal is periodic, additional measuring points after a respective 1/4 period theoretically yield the same results; in practice, this can be exploited for averaging (and thus for increasing the measurement accuracy). The fact that the signals are periodic can also be exploited in order to get by with a single analog-to-digital converter, as shown in FIG. 4: Four values are measured alternately in an interval of a quarter period each from $V_1$ (times $t_1$ to $t_4$), and then four values in an interval of a quarter period each from $V_2$ (time $t_5$ to $t_8$). This can be optionally repeated several times if increased accuracy is desired.

An (arbitrarily phase-shifted) sine wave of the frequency f, such as $V_1$ or $V_2$, can be represented as follows ($\omega=2\eta f$):

$$V_1=\alpha_1\cdot\sin(\omega t)+\beta_1\cdot\cos(\omega t)$$

$$V_2=\alpha_2\cdot\sin(\omega t)+\beta_2\cdot\cos(\omega t)$$

The coefficients can be determined from the measured values as follows:

$$\alpha_1=(V_1(t_2)-V_1(t_4))/2$$

$$\beta_1=(V_1(t_1)-V_1(t_3))/2$$

$$\alpha_2=(V_2(t_2)-V_2(t_8))/2$$

$$\beta_2=(V_2(t_5)-V_2(t_7))/2$$

This makes immediate sense, because, at $t_2$ and $t_4$ (i.e. after a ¼ and after a ¾ period), the cosine is 0, so the maximum and minimum of the sine component are measured, and at $t_1$ and $t_3$ (i.e. at the beginning of the period and after a ½ period), the sine is 0, so the maximum and minimum of the cosine component are measured.

In order to ensure that the analog-to-digital converter performs each measurement after exactly a quarter period, it is triggered with the fourfold measurement frequency $f_s=4\cdot f_{meas}$.

The current 1 through the coil 13 is proportional to the voltage at the series resistor 16, i.e. proportional to $V_1-V_2$. The voltage U at the coil 13 is $V_2$.

We thus have:

$$I=[(\alpha_1-\alpha_2)\cdot\sin(\omega t)+(\beta_1-\beta_2)\cdot\cos(\omega t)]/Rt_v;$$

and (where $\alpha=(\alpha_1-\alpha_2)/Rt_v$, and $\beta=(\beta_1-\beta_2)/Rt_v$)

$$I=\alpha\cdot\sin(\omega t)+p\cdot\cos(\omega t);\text{ and}$$

$$U=\alpha_2\cdot\sin(\omega t)+\beta_2\cdot\cos(\omega t)$$

The coefficients $\alpha$, $\beta$, $\alpha_2$, and $\beta_2$ can be easily calculated from the measured value as explained above.

The impedance of a coil can be set up as a series connection of an ohmic resistance R and an (ideal) inductance L; i.e.:

$$U=R\cdot I+L(d1/dt)$$

Substitution yields:

$$\alpha_2\cdot\sin(\omega t)+\beta_2\cdot\cos(\omega t)=R\cdot[\alpha\cdot\sin(\omega t)+\beta\cdot\cos(\omega t)]++L\omega[\alpha\cdot\cos(\omega t)-\beta\cdot\sin(\omega t)]$$

Summarized according to sin(ωt) and cos(ωt):

$$\sin(\omega t)\cdot(\alpha_2 R+L\omega\beta)=\cos(\omega t)\cdot(-\beta_2+R\beta+L\omega\alpha)$$

This equation can only be solved for all t if both sides are 0; we thus have two equations for R and L:

$$\alpha_2-R\alpha+L\omega\alpha=0$$

$$-\beta_2+R\beta+L\omega\beta=0\text{ or:}$$

$$R\alpha-L\omega\beta=\alpha_2$$

$$R\beta+L\omega\alpha=\beta_2$$

R and L can be easily calculated from this:

$$R=(\alpha\cdot\alpha_2+\beta\cdot\beta_2)/(\alpha_2+\beta_2)$$

$$L=(\alpha\cdot\beta_2-\beta\cdot\alpha_2)/((\alpha_2+\beta_2)\cdot\Omega)$$

It is thus possible to calculate the resistance and inductance, i.e. the impedance of the coil—from the measured values using only basic arithmetic operations. Consequently, one can get by with a lower-capacity microprocessor 18, which is optimal both in terms of cost and in terms of power consumption.

The microprocessor 18, which also has a clock-pulse generator 20 for the sine-wave generator 17, carries out the corresponding evaluation using a program 21.

Figure 5:
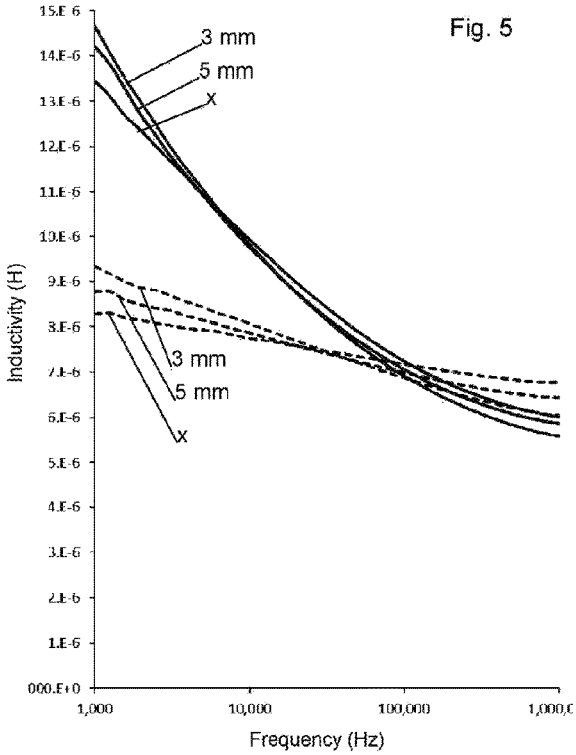
FIG. 5 shows the measured (frequency-dependent) inductance with ferromagnetic latch and ferromagnetic strike plate.
Figure 6:
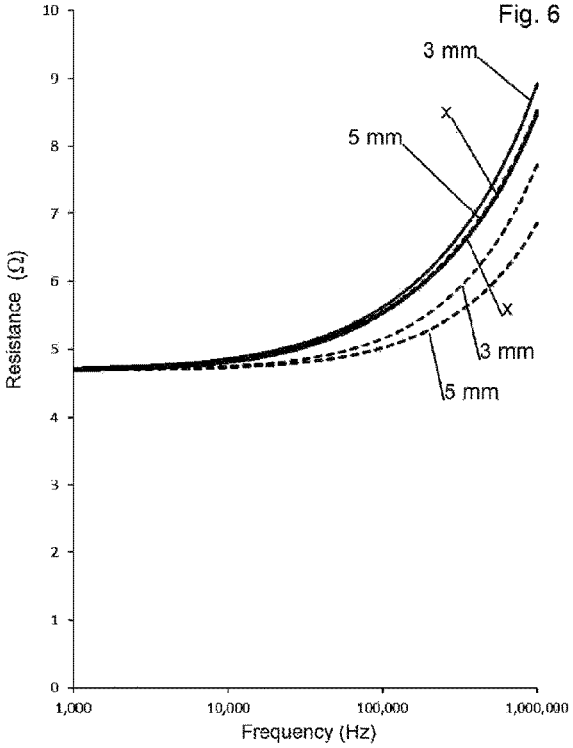
FIG. 6 shows the measured (frequency-dependent) resistance with ferromagnetic latch and ferromagnetic strike plate.

Typical values for a lock with ferromagnetic latch and ferromagnetic strike plate are shown in FIG. 5 (inductance) and FIG. 6 (resistance); particularly, measurements were respectively performed with extended latch (solid lines) and retracted latch (dashed lines) without strike plate (x), with strike plate with 5 mm clearance ("5 mm") and with strike plate with 3 mm clearance ("3 mm"). The frequency was varied between 1 kHz and 1 MHZ. It can be seen that the inductance increases sharply as a result of the extending of the latch, with the effect being most pronounced at 1 kHz. However, the strike plate also has a clearly recognizable effect, although it must be borne in mind no distinction need be drawn between "3 mm" and "5 mm"; after all, both mean that the door is closed. In this lock, it is thus possible to detect both "unlocked/locked" and "open/closed" with a single measurement at 1 kHz. The influence of the strike plate is low in the arrangement used; it would be greater (and the influence of the latch less) if the coil were not provided so tightly around the latch.

In this arrangement, the calculation of the resistance is also superfluous, as can be seen from FIG. 6; after all, the measured curves run very close together here, and the curves for "open/locked," "open/unlocked," and "5 mm/locked" actually coincide. If anything, with the latch retracted, the measured values at 1 MHZ could be used as an additional criterion for determining whether the door is open or closed.

Figure 7:
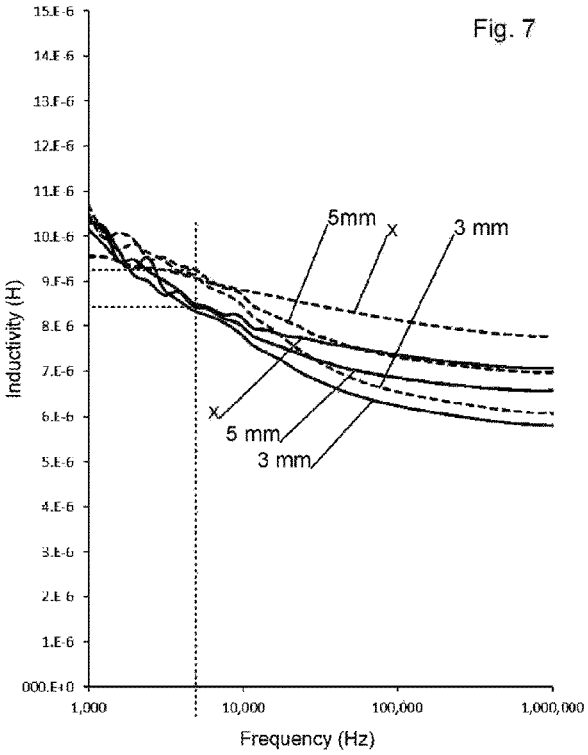
FIG. 7 shows the measured (frequency-dependent) inductance with non-ferromagnetic latch and non-ferromagnetic strike plate.
Figure 8:
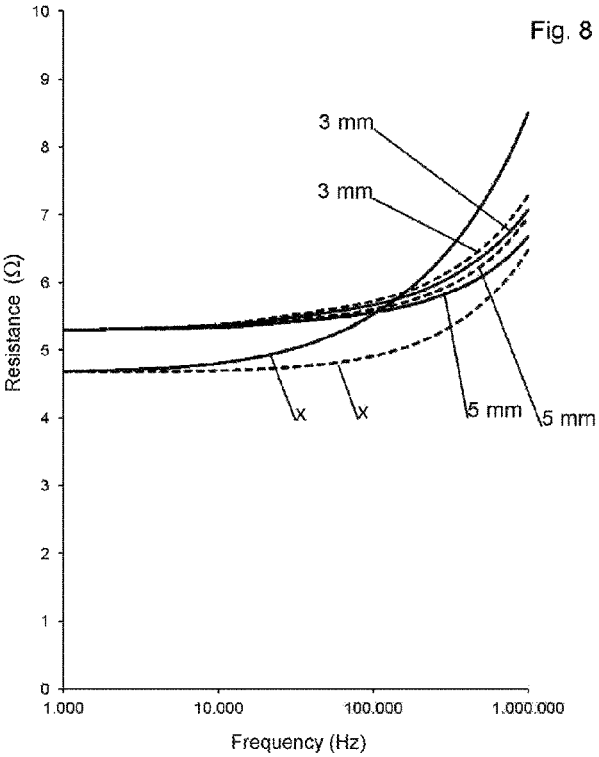
FIG. 8 shows the measured (frequency-dependent) resistance with non-ferromagnetic latch and non-ferromagnetic strike plate.

Typical values for a lock with non-ferromagnetic latch and non-ferromagnetic strike plate are shown in FIG. 7 (inductance) and FIG. 8 (resistance); particularly, measurements were again respectively performed with extended latch (solid lines) and retracted latch (dashed lines) without strike plate (x), with strike plate with 5 mm clearance ("5 mm") and with strike plate with 3 mm clearance ("3 mm"). The frequency was varied between 1 kHz and 1 MHZ.

It can be seen that it is substantially more difficult to distinguish the various statuses. It is advantageous to use the measured values of the resistance at 1 kHz in order to identify whether the door is open (measured value below 5Ω) or closed (measured value above 5Ω). Whether or not the latch is extended can be determined from the inductance measured at approximately 5 kHz, where the measured values are (almost) independent of the status of the door and are clearly below 9 pH when the latch is extended and right over 9 pH when the latch is retracted.

Figure 9:
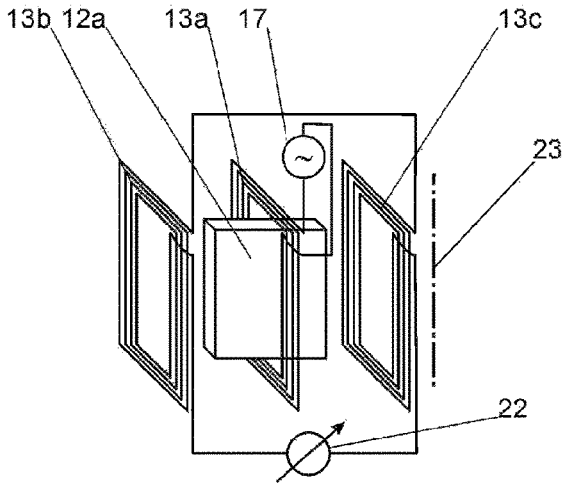
FIG. 9 is a schematic view of a second embodiment of the present invention with one transmitter coil and two receiver coils.

FIG. 9 shows a second embodiment of the present invention, in which a transmitter coil 13*a* is provided between two receiver coils 13*b* and 13*c*. The transmitter coil 13*a* is fed with a 1.5 MHZ signal from a sine-wave generator 17. Since a single frequency can be sufficient with this embodiment, the sine-wave generator 17 can be constituted by a square-wave generator with a subsequent bandpass filter. The two receiver coils 13*b* and 13*c* flank the transmitter coil 13*a* and are adjacent a strike plate illustrated schematically at 23. Furthermore, a metallic body 12*a* is shown intended to represent a latch element. As long as the body 12*a* is positioned exactly symmetrically, the arrangement as a whole is symmetrical, so that the differential voltage measured by an alternating-voltage voltmeter 22 must be zero.

Figure 10:
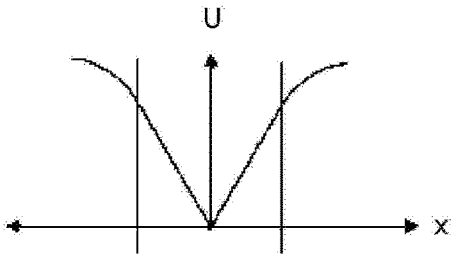
FIG. 10 is a graphic illustration of the measured voltage as a function of the position of the iron core in the second embodiment.

If the body 12*a* is displaced by an amount x, however, this results in a measurable differential voltage which becomes greater as x increases (see FIG. 10).

Figure 11:
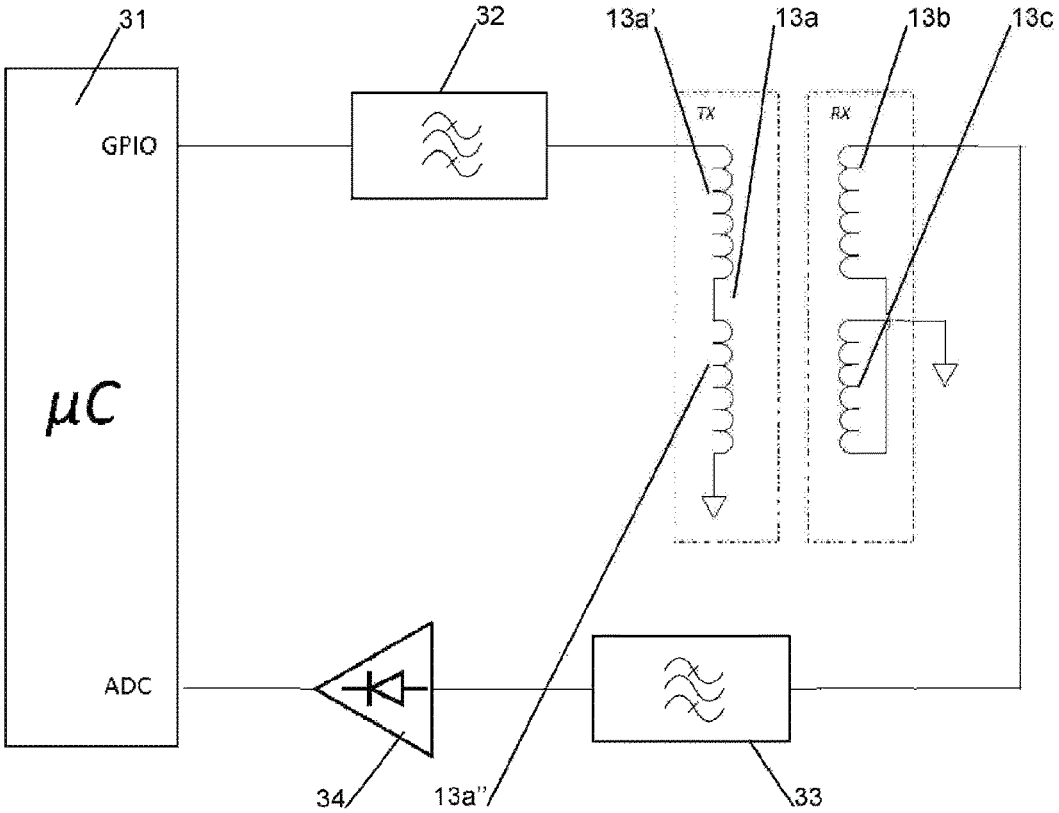
FIG. 11 is a schematic diagram of the circuit for measurement of this voltage.

A specific circuit is indicated in FIG. 11. A microprocessor 31 is provided that supplies a square-wave voltage at a pin GPIO (=general purpose I/O, general purpose input/output contact pin). This square-wave voltage is filtered in a bandpass filter 32 to a sinusoidal voltage and applied to the transmitter coil 13*a*. The two receiver coils 13*b*, 13*c* (in fact provided on both sides of the transmitter coil 13*a* as shown in FIG. 9) are connected such that their differential voltage is tapped and fed to an additional bandpass filter 33.

This bandpass filter 33 filters out interference signals. Downstream of the bandpass filter 33, the signal is rectified and amplified in a measuring rectifier 34 and fed to an ADC input (ADC=analog digital converter) of the microprocessor 31.

Although one can manage with one transmitter coil 13*a*, it is also possible to provide two transmitter coils 13*a*, 13*a* connected in parallel or—as shown in FIG. 11—in series. This is advantageous if, for technical reasons, it is easier to manufacture four layers than three layers.

With such an arrangement, the following voltages were measured using coils mounted on the face plate (the unit is arbitrarily selected):

TABLE 1

| | Closed and locked | Open and locked | Closed and unlocked | Open and unlocked |
|---|---|---|---|---|
| Ferromagnetic bolt | 3791 | 3882 | 3966 | 4004 |

TABLE 1-continued

| | Closed and locked | Open and locked | Closed and unlocked | Open and unlocked |
|---|---|---|---|---|
| Nonferro-magnetic bolt | 3573 | 3712 | 3739 | 3845 |

As can be seen, all of the statuses can be clearly distinguished from one another, both with ferromagnetic and non-ferromagnetic bolts.

If the coils are mounted on the face plate, there is always more metal inside of the lock than outside, so the strongest signal will be measured when the door is open and unlocked, and the weakest signal will be measured when the door is closed and the lock locked (latch extended).

In contrast, if the coils are mounted on the strike plate, then more material is on the inside than on the outside when the door is open, while the opposite is the case when the door is closed. As a result, the phase shift changes between the signal that is received and the signal that is fed in. In this case, it can therefore be advantageous to also determine the phase shift.

As can be seen from FIG. 4, the influence of the ferromagnetism falls sharply as the frequency rises, and it hardly exists starting at approximately 100 kHz. It is for this reason that a high frequency of 1.5 MHZ is selected in this embodiment.

The invention claimed is:

1. A window or door lock comprising:

a face plate;

a strike plate, one of the plates being movable relative to the other of the plates on opening and closing of the window or door;

a metallic locking element that can be extended through an opening of the face plate into an opening of the strike plate when the plates are juxtaposed in a closed position of the door in which the plates are closely juxtaposed;

a transmitter coil mounted on the face plate or the strike plate and extending around the opening thereof, the transmitter coil extending around the locking element in an extended position thereof in at least the closed position of the door;

a pair of receiver coils flanking the transmitter coil, the transmitter and receiver coils being between the strike plate and the face plate;

means for applying an alternating-current voltage to the transmitter coil and thereby inducing voltages in the receiving coils indicating the extension of the locking element and the juxtaposition of the strike and face plates; and a sensor for measuring the difference between the voltages induced in by the transmitter coil in the receiver coils and thereby determining whether or not the bolt is extended and whether or not the door or window is closed.

2. The lock defined in claim 1, wherein the transmitter coil is mounted on a flexible printed circuit.

3. The lock defined in claim 1, further comprising:

means for comparing the measured voltages with predetermined values.

4. The lock defined in claim 3, further comprising:

means storing values of the measured voltages and for reconstructing the predetermined values based on an average of the latest measured values.

5. A method of determining whether a door or window is open or closed and whether the door or window is locked, the method comprising the steps of:

providing a strike plate;

providing a face plate, one of the plates being movable relative to the other of the plates on opening and closing of the window or door;

providing a metallic locking element that can be extended through an opening of the face plate into an opening of the strike plate when the plates are juxtaposed in a closed position of the door in which the plates are closely juxtaposed;

providing a transmitter coil mounted on the face plate or the strike plate and extending around the opening thereof, the transmitter coil extending around the locking element in an extended position thereof in at least the closed position of the door;

providing a pair of receiver coils flanking the transmitter coil, the transmitter and receiver coils being between the strike plate and the face plate;

applying an alternating-current voltage to the transmitter coil and thereby inducing voltages in the receiving coils indicating the extension of the locking element and the juxtaposition of the strike and face plates; and measuring a difference between the voltages induced by the transmitter coil in the receiver coils and thereby determining whether or not the bolt is extended and whether or not the door or window is closed.

* * * * *